United States Patent [19]

Andrei-Alexandru et al.

[11] 4,381,625

[45] May 3, 1983

[54] DOOR LOCKING DEVICE

[75] Inventors: Marcel Andrei-Alexandru, Bietigheim-Bissingen; Klaus Ott, Heilbronn; Hans Prohaska, Bietigheim-Bissingen, all of Fed. Rep. of Germany

[73] Assignee: ITT Industries Inc., New York, N.Y.

[21] Appl. No.: 358,301

[22] Filed: Mar. 15, 1982

Related U.S. Application Data

[63] Continuation-in-part of Ser. No. 103,535, Dec. 14, 1979, abandoned.

[30] Foreign Application Priority Data

Dec. 18, 1978 [DE] Fed. Rep. of Germany ..... 2854713

[51] Int. Cl.[3] ..... E05F 15/00

[52] U.S. Cl. ..... 49/280; 49/72; 49/349

[58] Field of Search ..... 49/72, 280, 349

[56] References Cited

U.S. PATENT DOCUMENTS

| | | | |
|---|---|---|---|
| 2,774,624 | 12/1956 | Lower | 49/280 X |
| 3,024,062 | 3/1962 | Himka et al. | 49/72 X |
| 3,145,988 | 8/1964 | Colautti et al. | 49/280 |
| 3,608,241 | 9/1971 | Mazure | 49/72 |

*Primary Examiner*—Kenneth Downey

*Attorney, Agent, or Firm*—James B. Raden; William J. Michals

[57] ABSTRACT

A combination power window and power door locking device for use in an automotive vehicle door. The locking of the door is accomplished by rotatably mounting the common motor in the door and resiliently urged toward an angular stop position. After the window pane is in one of its end positions, continued application of external power to the motor rotates the motor away from the stop position to activate the door locking mechanism.

1 Claim, 18 Drawing Figures

DOOR LOCKING DEVICE

This application is a continuation-in-part of our application Ser. No. 103,535 filed Dec. 14, 1979, now abandoned.

BACKGROUND OF THE INVENTION

The invention relates to an installation for adjusting a window pane in a motor vehicle of the type having a motor, a gearing arrangement and a power transmission connecting the gearing to the window pane.

Such installations are increasingly built into motor vehicles in order to facilitate opening and shutting of windows in the doors of the motor vehicle for the passengers. For this purpose an electric motor with gearing and means for transmission of power to the window pane are located in the lower part of the vehicle door.

In addition to a window regulator many vehicles are equipped with a central door locking installation which admits to lock and unlock all doors from one point or from various points about the vehicle. For this purpose a drive aggregate which can be an electric motor is also necessary in each vehicle door. Further, this motor with its gearing and the power transmission mechanism must be accomodated in the lower part of the vehicle door.

In known installations thus two electric motors are necessary for moving the window as well as the door locking device. Accordingly, the costs for two electric motors are essentially double. Also the wiring efforts for the motors are considerable. Besides it is extremely difficult additionally to accomodate two drive aggregates with the related mechanisms for power transmission in the lower part of the vehicle door in which, when the window is open, the window pane is located.

It is therefore the object of the present invention to reduce the costs for window regulator and door locking device, to reduce the space in the vehicle door for these aggregates and thus to facilitate accomodation. The changes must be made in such a way that it is still possible to move the window pane and the door locking device independently of each other. The changes should be very simple too, but inspite of this ensure a proper functioning.

SUMMARY OF THE INVENTION

According to the invention only one electric motor is provided by which the window pane and the door locking and unlocking device can be adjusted. Thus the wiring efforts are reduced considerably, and by saving one drive aggregate the costs can be lowered. Further, the single electric motor can be more easily accomodated in the narrow space available in the door frame.

It is indeed well imaginable to design the mechanism for transmission of motion in such a way that at any time the window is moved the locking installation is adjusted too and that the door can only be locked, when the window is completely shut, and unlocked when the window is completely open. Such an installation would, however, have quite unusual and inconvenient properties for the passengers. In order to retain the nature of usual window regulators and door locking installations as far as possible it is provided that window pane and door locking device are adjustable at least partly one after the other.

According to a further embodiment of the present invention, the installation is appropriately developed in such a way that window pane and door locking device can only be moved one after the other. Thereby it is ensured that only that unit is adjusted whose adjustment is desired at the time being. Thus for instance a locking is only possible, when the window is blocked in upward direction. The window can only be moved downwards, when the locking was previously released. Thereby preferably a blocking of the window upon hitting its upper frame is utilized. Thereby it is ensured that at first the window is shut, when a locking command is given. It is, however, also imaginable to provide an adjustable stop, so that a motion of the window can already be blocked before the upper frame. This is especially desirable in the summer in order to retain fresh air supply for children or domestic animals left in the car.

Because a window can only be opened, when the door of the vehicle is unlocked, it is impossible to open the windows during the unlocking operation of the vehicle. As soon as the vehicle door is unlocked the window can be moved independently thereof in upward or downward direction.

The desired characteristics of the installation also can be realized, when according to another embodiments two elements reciprocally acting with each other are provided, of which the first is connected directly or indirectly with the motor and the second directly or indirectly with the window pane. If, due to a blocking of the window or because of a stop directly acting on the second element or on a part between the second element and the motor, this element cannot carry out a motion which would result in an adjustment of the window, so at least the first element is movable, whose present motion is utilized for locking and unlocking. But it is possible too that besides the first element also the second carries out a motion which indeed does not result in an adjustment of the window, but may be utilized for actuating the door locking installation.

In order to arrange that a blocking of the window is only necessary in upward direction according to another embodiment it is provided that the necessary resistance threshold levels in which the second element is at rest relative to an adjustment of the window pane, but the door locking device can be actuated, are of different heights for the two moving directions. This can be achieved in that an unlocking is easier to be effected than a downward motion of the window and it is more difficult to effect a locking than to move the window in upward direction.

It is therefore appropriate according to still other embodiments to provide a resilient holding element against the resistance of which a locking of the door takes place. Thereby the holding element effects that it is more difficult to lock the door than to lift the window. Because the electric motor is self-locking, the door remains locked. Only when an unlocking is to be effected and the motor is thereby started the resilient holding element can relax again and thereby supports the unlocking of the door or effects it alone, whereby the unlocking can be more easily executed now than the downward motion of the window.

If the holding element also exercises opposed equal forces into opposite moving directions additional stops are provided which are blocking a downward motion of the window. This is for instance the case, when the holding element is a sliding clutch.

In order to eliminate even the slightest possibility of a faulty functioning of the installation it is desirable to provide between the mechanism for lifting and lowering of the window and the mechanism for locking and unlocking the door, according to still another embodiment of the present invention, an element which can be locked unilaterally or reciprocally. Accordingly, the door locking mechanism is locked as long as the window is open and is only unlocked, when the window is shut. It can, however, be provided too, to adjust the unlocking point manually. In the same manner the window can be locked against a downward motion as long as the door has not completely unlocked.

In one development the installation is designed in such a way that the further means for power transmission are only movable in a clearly defined position of the second element. This position is firm relative to an adjustment of the window, the second element can thus under certain circumstances carry out another motion additionally which does not affect the window. Between the further means for power transmission and the first or second element, or between the power transmission means themselves, a mechanical connection is interrupted thereby. Only a motion of the window which is affected after its blocking provides a connection and enables a locking of the door. In the unlocking process the connection is released again. Thereby an embodiment is preferred in which during adjustment of the window the first and second element can only be moved between two final points and in the one final point one of the elements acts upon the further power transmission means. Thus, when the window is adjusted from one end position to the other the elements no longer carry out several rotations.

Because, however, also in this embodiment because of unavoidable work tolerances which can become bigger due to wearing during operation the firm position of the second element can only be reached nearly, it is more favourable, when the further power transmission means may be acted upon in any desired position of the second element insofar as this element is blocked only. Then at least one of the two elements, preferably the first, adjusts the further power transmission means by a motion, which can be another one than during the window lifting operation. This is effected in a simple manner in that a rotation is changed into an axial motion or an initially firm axis of rotation is swivelled round another axis of rotation.

Thereby especially little has to be changed in existing installations, when the motor itself is rotatable round an axle, preferably its driven shaft or the axis of rotation of a toothed segment mating with its pinion. If this rotation of the motor is not desired or possible on grounds of space, the worm shaft too can be developed in two portions, so that a blocking of the worm wheel causes an axial motion of the free part of the worm. It is even possible to displace the entire armature axially, when the armature shaft is made in one piece. The motion which is executed by the first and/or second element after the window is blocked can be transmitted on the door lock in an especially advantageous manner, if a Bowden cable is included in the further means for power transmission. A Bowden cable is flexible and can therefore be especially easily be accomodated in the door frame. Because through the Bowden cable a motion can only be transmitted, when its covering and its core are displaced relative to each other, the arrangement can be made in such a way that the motor-sided end of one of these parts is firmly connected with the vehicle body, whereas the other is moved for locking and unlocking purposes. The effectiveness of the Bowden cable only upon relative displacements between covering and core can advantageously be used too on the one hand to fix the covering and on the other hand to fix the core on two movable parts whose space between the two fastening points does not change, when the window is lifted or lowered. Preferably covering and core are fixed on the first and second element.

BRIEF DESCRIPTION OF THE DRAWING

The invention is described below by way of the embodiments shown in the accompanying drawings, in which.

DETAILED DESCRIPTION

Figure 1:
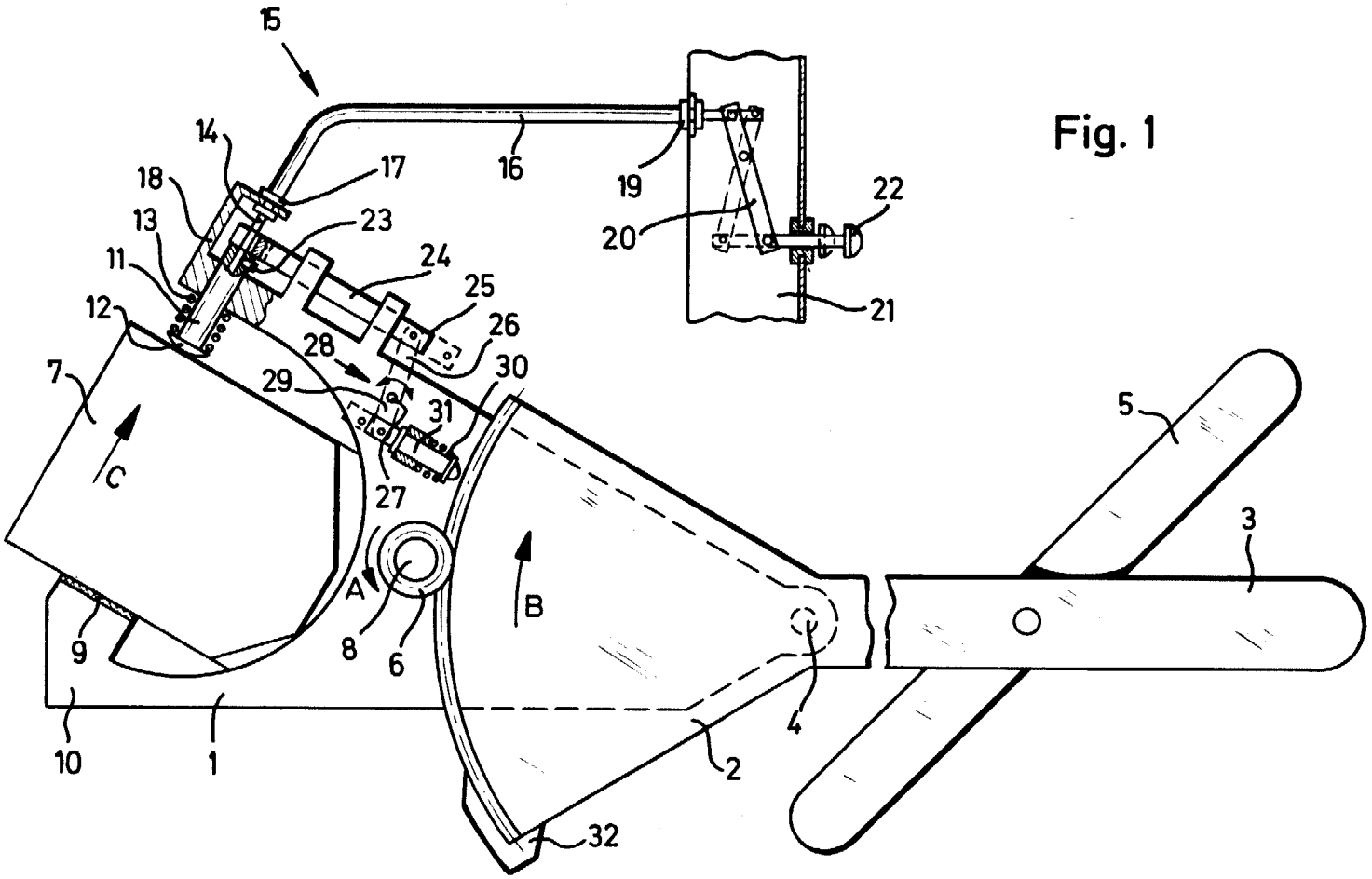
FIG. 1 is a view of an embodiment according to the invention comprising an electric motor which may be swivelled round its driven shaft.

FIG. 1 shows an embodiment according to the invention in which a locking is possible in any position of the window, insofar as in this position the window is blocked in upward direction. The entire installation is fastened on the sheet metal holder 1. A toothed segment 2 which is produced in one piece with the rod 3 is rotatably mounted on the axle 4 on the sheet metal holder 1. A further rod 5 is rotatably connected with the rod 3, which rod 5 is displaceably suspended in a rail on a window pane like the rod 3. The toothed segment 2 is mating with the pinion 6 of the electric motor 7. The axle 8 on which the pinion 6 of the electric motor 7. The axle 8 on which the pinion 6 is arranged in manner protected against rotation can rotate in stationary bearings on the sheet metal holder 1 or other additional fastening members. Because the motor 7 is not fixed in further points it can, within certain limits, rotate round the axle 8. At one side these limits are formed by the stop 10 covered with a shock-absorbing material 9 and at the other side by the bolt 11 which supports on the sheet metal holder 1 via the helical spring 13 resting against its head 12. The bolt 11 is displaceable in axial direction in a bearing of the sheet metal holder 1. On said bolt the core 14 of a Bowden cable 15 is fixed by the screw 23, whereby in the end 17 the covering 16 is unmovably connected with a stud 18 of the sheet metal holder 1 and which Bowden cable is connected to the door lock of the corresponding vehicle door. There the covering 16 with its other end 19 is again unmovably fastened, whereas the core 14 acts on a lever mechanism 20 which can be adjusted too by the knob 22 located on the vehicle door 21.

An additional protection is provided against unintended locking of the doors, which above all becomes important, when the window is blocked against an upward motion in an opened position. For this purpose the bolt 11 is acted upon by the rod 24 displaceably supported on the sheet metal holder 1. With its end 25 being far from the stop 23 said rod is connected with an arm 26 of a two-armed lever 28 to be swivelled on the axle 27, whereby the other arm 29 of said lever can be adjusted by a bolt 31 displaceable against the spring 30. The displacement of the bolt 31 is thereby achieved via the stop cam 32 which has its seat on the toothed segment 2.

In the position of the entire installation shown in the drawing the window is wide open and the door is unlocked. If now the window is to be shut or the door to be locked, the motor is poled in such a way and connected with the voltage source that the pinion 6 rotates in direction of arrow A and drives the toothed segment in direction of arrow B. Because less power is necessary to lift the window than to lock the door and to press the spring 13 which is additionally protected against a motion by stopping the bolt 11 on the rod 24, the motor remains in the position shown. Finally the bolt 31 stops on the slope 32, so that the rod 24 is drawn back into the position indicated by dotted lines. The motor remains in the position shown until the window is completely shut and blocked. If only the window is to be shut, the motor becomes currentless, so that no further motion is effected. If, however, the door is to be locked, the motor is continued to be supplied with voltage. But because the toothed segment 2 and thus the pinion 6 are blocked the motor rotates in direction of arrow C, so that the bolt 11 and the core 14 are adjusted and the door is locked. As soon as the locking is effected, the motor is switched off. If a command for unlocking is given, the motor, opposite to the direction of arrow C, returns into the position shown, because for this purpose less power is needed than for a downward adjustment of the window. Thereby the motor is assisted by the spring 13, which is responsible for the unlocking operation. After the unlocking is terminated the window can again be moved as desired. In the embodiment described the first and second element are two gearing parts of the motor, for instance the worm and the worm wheel; the holding member is formed by the spring 13 which simultaneously causes resistance threshold values of different height for the locking and unlocking operation.

Figure 3:
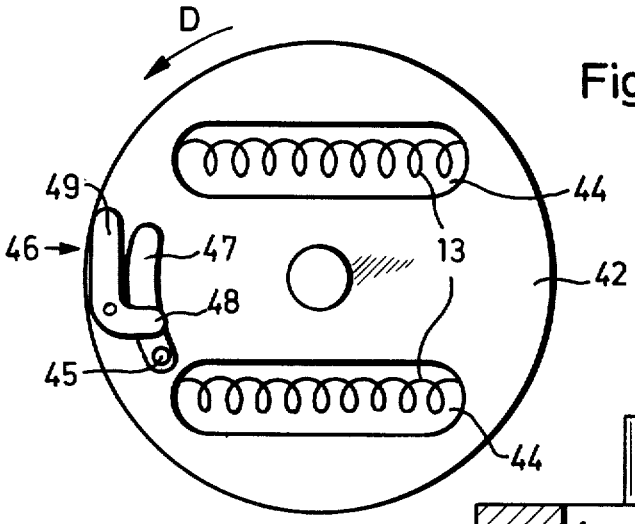
FIG. 3 is a view from below on the embodiment according to FIG. 2.
Figure 2:
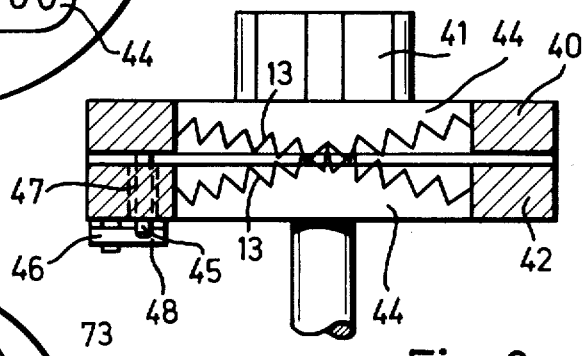
FIG. 2 is a section through a part of the second embodiment in which the first and second element are two disks carrying a device each of which one is adjustable.

In the embodiment according to FIGS. 2 and 3 the disk 40, firmly connected to the gear 41, represents the second element, which stands still when the window is blocked. The disk 42 as first element is driven by an electric motor. The motion of said disk may be transmitted on the disk 40 via springs 13 acting as holding members too and being located in grooves 44. The disks 40 and 42 are additionally carrying a pin 45 and an angular lever 46. Thereby the pin 45 is gripping through a groove 46 of the disk 42 and with its lateral limitation concentrically arranged to the rim of said disk and with its end it is adjacent to the arm 48 of the lever 46.

If the pinion and thereby the disk 40 is blocked, but the disk 42 continues to be moved into direction of arrow D by the motor, the arm 48 of the lever 46 hits the stationary pin 45 and the arm 49 of the lever is swivelled out. This motion is used for door locking purposes. Because the arm 49 thereby has to co-operate with further power transmission means whose adjustment is only possible in this position of the disk 40, because otherwise the lever 46 would be swivelled into empty space.

Figure 4:
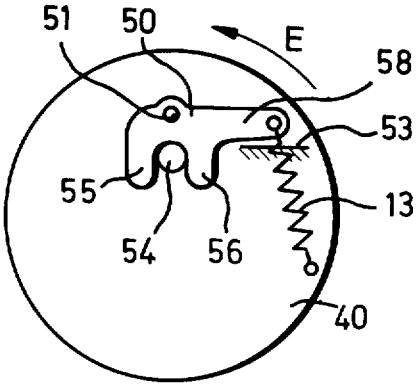
FIG. 4 is a part of an installation similar to that of FIGS. 2 and 3, whereby both elements are occupying the position they have, when the window is moved.
Figure 5:
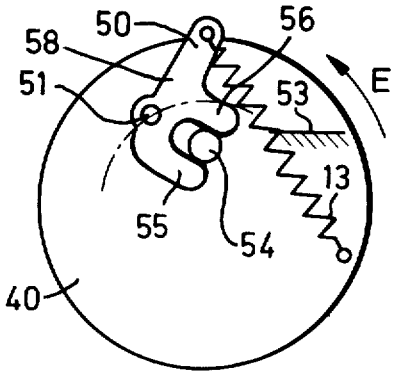
FIG. 5 shows the elements of FIG. 4, when the door is locked.

Whereas in the embodiment just described the coupling between first and second element is effected by springs which are not acting on the additional mechanisms, in the embodiment according to FIGS. 4 and 5 two disks are coupled with each other via these additional mechanisms. The lever 50 is thereby rotatably mounted in the point 51 on a disk not shown in detail. The disk 40, which is connected with the window via other power transmission means, has a stop 53 and a pin 54 which is located between two studs 55 and 56 of the lever 50. A spring 13, which with its one end is connected to the disk 40 and with its other end to the arm 58 of the lever 50, pulls said arm towards the stop 53.

If the disk 40 is rotated in direction of arrow E the window is shut. Said disk is thereby taken along by the lever 50 via the spring 13 and the pin 54. If the window is blocked, the pin 54 and the end of the spring 13 fastened to the disk 40 are at rest. Because the point 51 continues to move, due to the pin 54 the lever is swivelled against the resistance of the spring 13, which is a holding member, into the position shown in FIG. 5. This motion is used for locking of the door. When the direction of rotation is reversed, the lever 50 is again pulled to the stop 53 thereby effecting unlocking.

If FIGS. 2 to 5 the adjustable lever is mounted on the first element, thus on the disk which is still moved, when the window is blocked. But it is just as well possible to secure the levers on the second element, thus on the disk 40, and to arrange the mechanisms carrying the disks 42 on the respective first elements 40. This has the advantage that the point of rotation of the lever is at rest after the second element was blocked and only the lever is still swivelled.

Figure 6:
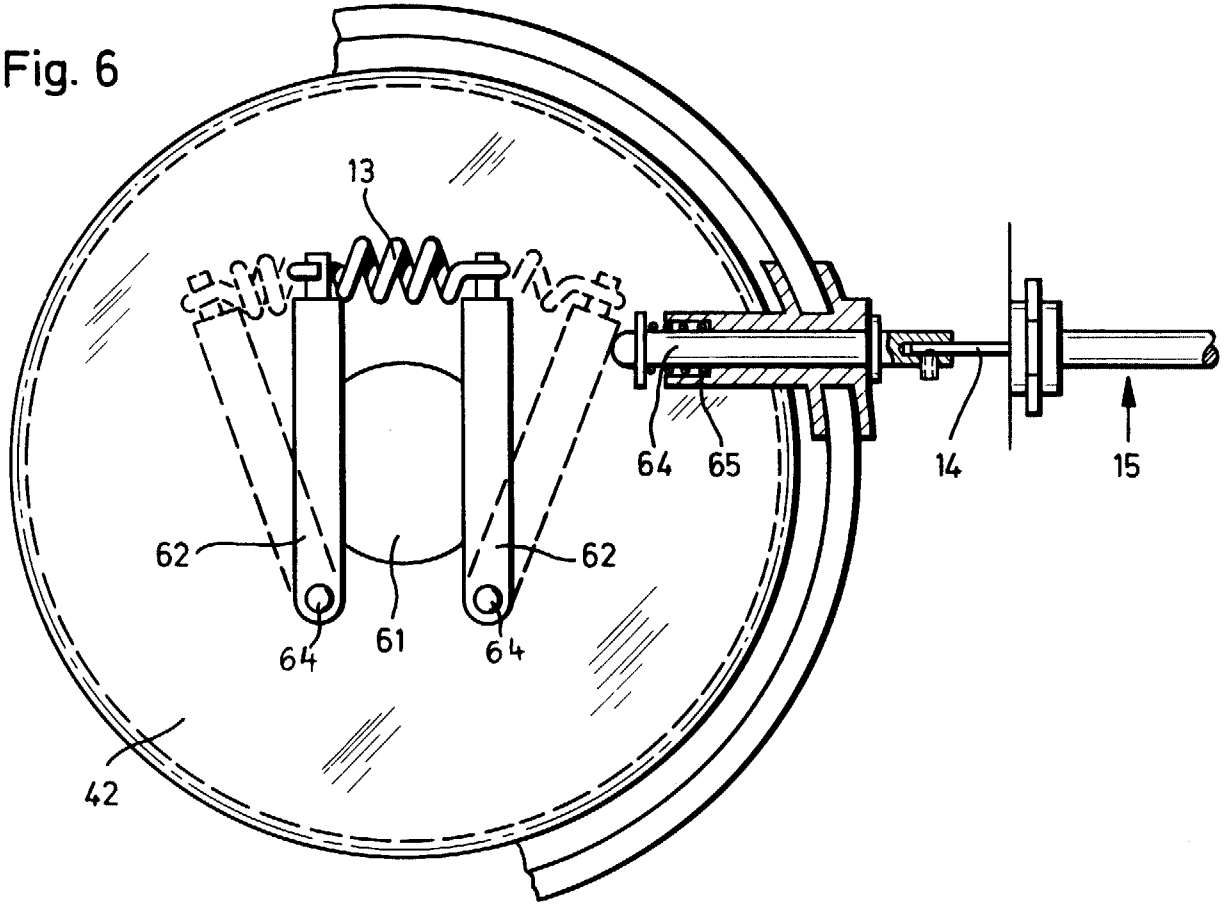
FIG. 6 is a further embodiment, in which, upon blocking of the disk representing the second element two levers mounted on said disk are tilted.

FIG. 6 shows such a design. The gear 42 is driven by the motor and in a manner protected against twisting carries the pivot with cheeks 61 as a driver. On a second disk, which is not shown in the drawing, the two one-armed levers 62 are mounted which by the spring 13 are pressed against the pivot with cheeks 61 and thus are coupling the two disks with each other. If the two points of support 64 are prevented from a further motion, that means the disk not shown in the drawing is blocked, then a further rotation of the pivot with cheeks 61 causes a swivelling of the two levers into the positions shown by dotted lines. This is effected against the force of the spring 13. Thereby the bolt 64, on which the core 14 of a Bowden cable 15 is secured, is adjusted against the force of the spring 65 and thus the door is locked. Because the motor is self-locking the entire system remains in this position until the motor rotates in the other direction. This results at first in an unlocking of the door and, if required, in an opening of the window.

Figure 8:
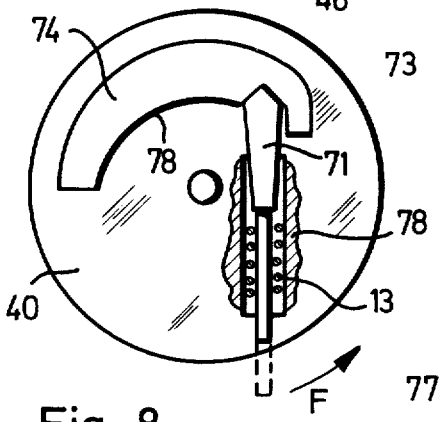
FIG. 8 is a view of locking cam and locking bolt of FIG. 7.
Figure 7:
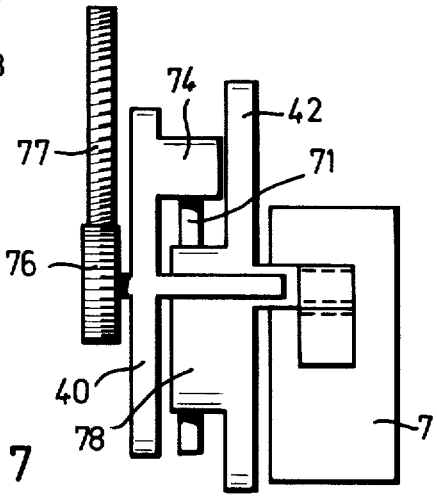
FIG. 7 is a view of a motor with gearing, by which two disks serving as first and second element may be driven of which the one is carrying a locking cam and the other a displaceable locking bolt.

The FIGS. 7 and 8 show an electric motor 7 driving the disk 42 via a gearing. Said disk has a driver 71 which by the pressure spring 13 is pressed into the notch 73 on the cam guide 74 of the disk 40. The disk 40 and the pinion 76 mating with the toothed segment 77 are rotatably mounted in the disk 42. The driver 71 can displace in its bearing 78 in axial direction. When the disk 40 is blocked by the window or by a stop, the disk 42 with the driver is rotated further into direction of arrow F, insofar as a locking of the door is required. The driver therefore leaves its notch 73 and slides along the cam guide 74. The leaving of the notch is connected with an axial motion of the driver 71 which is used for locking purposes. The cam 78 is thereby developed in such a way that the driver is projecting equally far over the rim of the disk 40 during the motion of the disk 42. When the direction of rotation is reversed, the driver snaps in again due to the spring 13. The door is unlocked by springs fitted into the locking mechanism which springs can relax now.

Figures 9, 10:
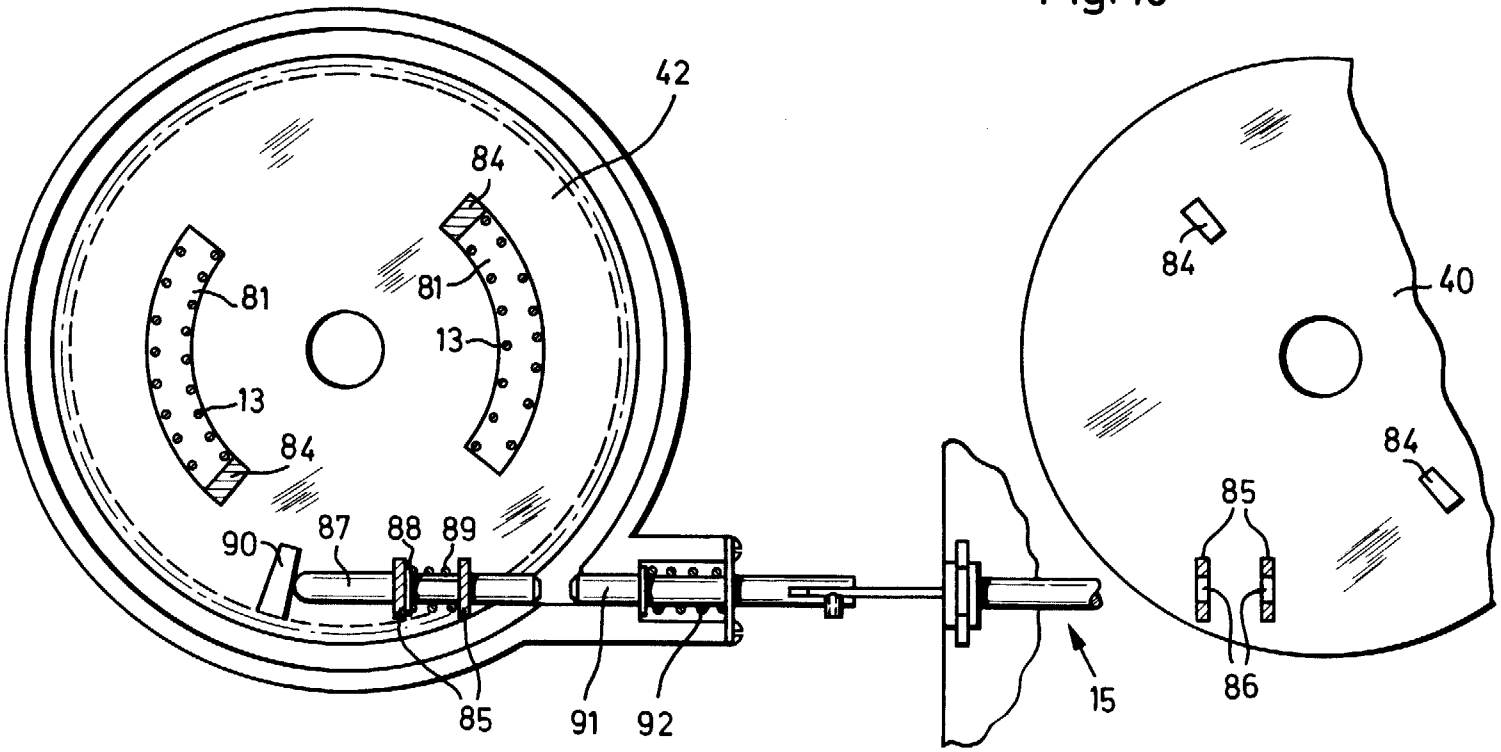
FIG. 9 is a top view on a further embodiment with longitudinally displaceable bolt which is held on the second element.
FIG. 10 is a top view on the side of the disk of FIG. 9 representing the second element which faces the first element.

Whereas in the embodiment according to FIGS. 7 and 8 the adjustable mechanism, namely the driver 71, is held on the first element 42, thus after blocking of the second element is still moved with the first element, FIGS. 9 and 10 show a design in which the adjustable mechanism is again connected with the second element.

The gear wheel 42 has arc-shaped circular recesses 81, in which the springs 13 are located. The disk 40 is engaging into the recesses 81 with two drivers 84 which are squeezed between the respective ends of the recesses 81 and the springs 13. Thus the gear wheel 42 and the disk 40 in one direction of rotation are directly coupled with each other and in the other direction of rotation via the spring 13. On the disk 40 two lugs 85 are arranged in such a way that in said lugs 85 two bores 86 are in alignment with each other. This provides that the bolt 87 can be put through after the washer 88 and the spring 89 were at first brought between the two lugs. The bolt 87 is acted upon by the stud 90 of the gear wheel 42.

When in the position shown the disk 40 is blocked, the stud 90, against the force of the spring 89, presses the bolt 87 against the further bolt 91 which in longitudinal direction is displaceable against the force of the spring 92. Thereby the door is locked via the Bowden cable 15. The unlocking is effected as already described.

Figure 11:
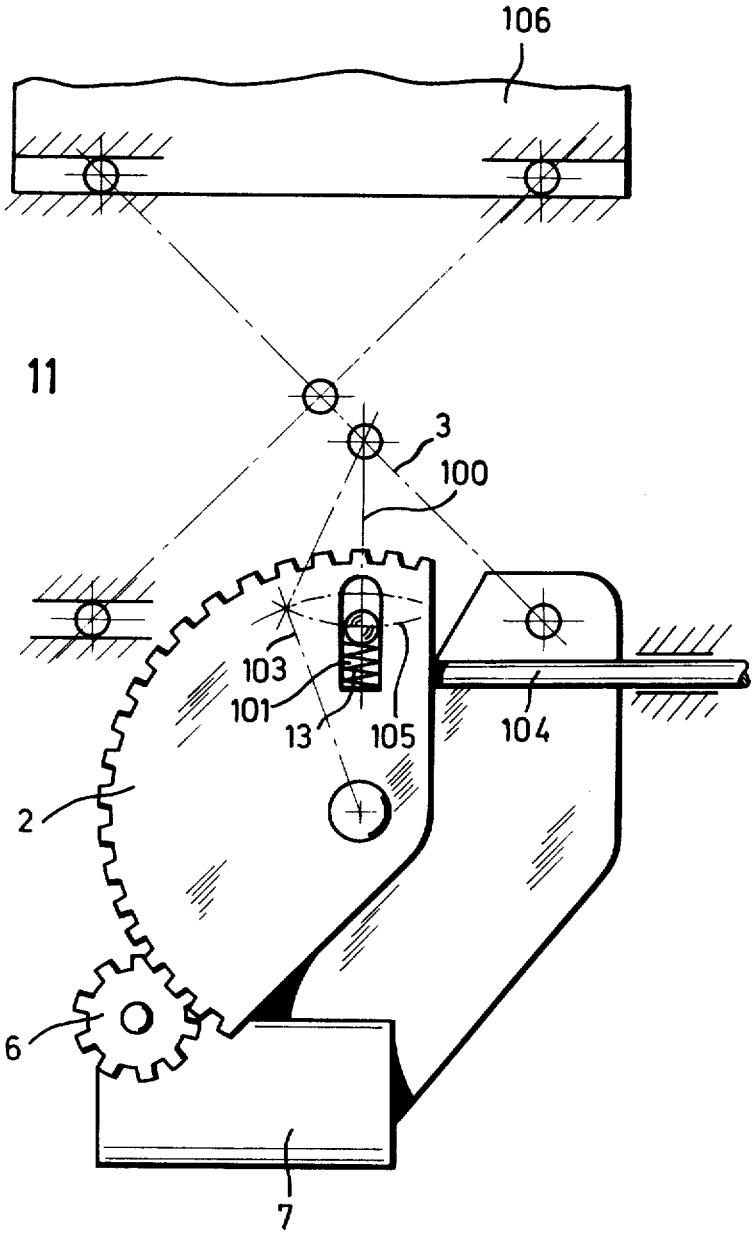
FIG. 11 depicts an installation in which the further means for power transmission may be acted upon by a toothed segment, when the window is shut.

The embodiment of FIG. 11 has a rod 100 as a second element which is movable too, when the window pane 106 is blocked. For this purpose the rod 100 is mounted in an oblong hole 101 of the toothed segment 2, whereby it supports on one end of said oblong hole 101 via a spring 13. The other end of the rod 100 is rotatably connected with the rod 3. The toothed segment 2 is driven by the pinion 6. As soon as during the shutting operation of the window the oblong hole 101 has reached the radius 103 shown by dotted lines the window is shut. During this motion the rod 100 is pressed against the upper end of the oblong hole 101 by the spring 13. At a further motion of the toothed segment the rod 104 is moved via which the door is lockable. Because during this further motion the upper end of the rod 100 is fixed, the lower end of said rod 100 is running on the circular arc 105 and continues to initially tension the spring 13. This spring is thus acting as a holding member. During the unlocking operation the process is reversed, the rod 104 is reset by a spring element. If only an unlocking is desired the motor 7 and the toothed segment 2 come to a standstill as soon as the oblong hole is again located on the radius 103. In a further motion the rod 3 is taken along again and thus the window is opened.

Figure 12:
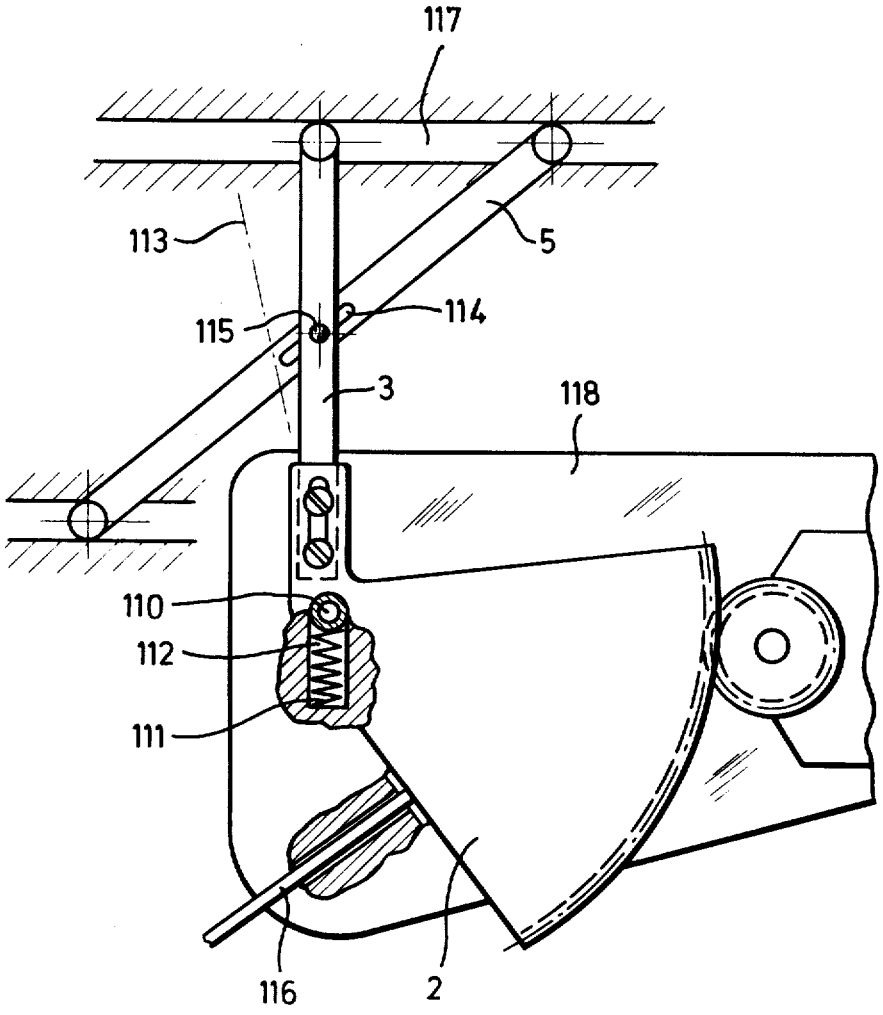
FIG. 12 depicts an installation similar to that of FIG. 11, but with differently arranged holding member.

A similar embodiment is shown in FIG. 12 in which the toothed segment 2 is mounted on an axle 110 which can be displaced in an oblong hole 112 of the plate 118 against the force of the spring 11. This makes it possible that the toothed segment 2 and the rod 3 connected with it move beyond the dash-dotted line 113; when said line is reached, the window is shut. In order to prevent a locking of the rod 5, the one rod has an oblong hole 114 in which the pin 115 of the other rod is guided. As soon as the rod 3 passes the line 113 the bolt 116 which locks the door is displaced by the toothed segment.

Figure 13:
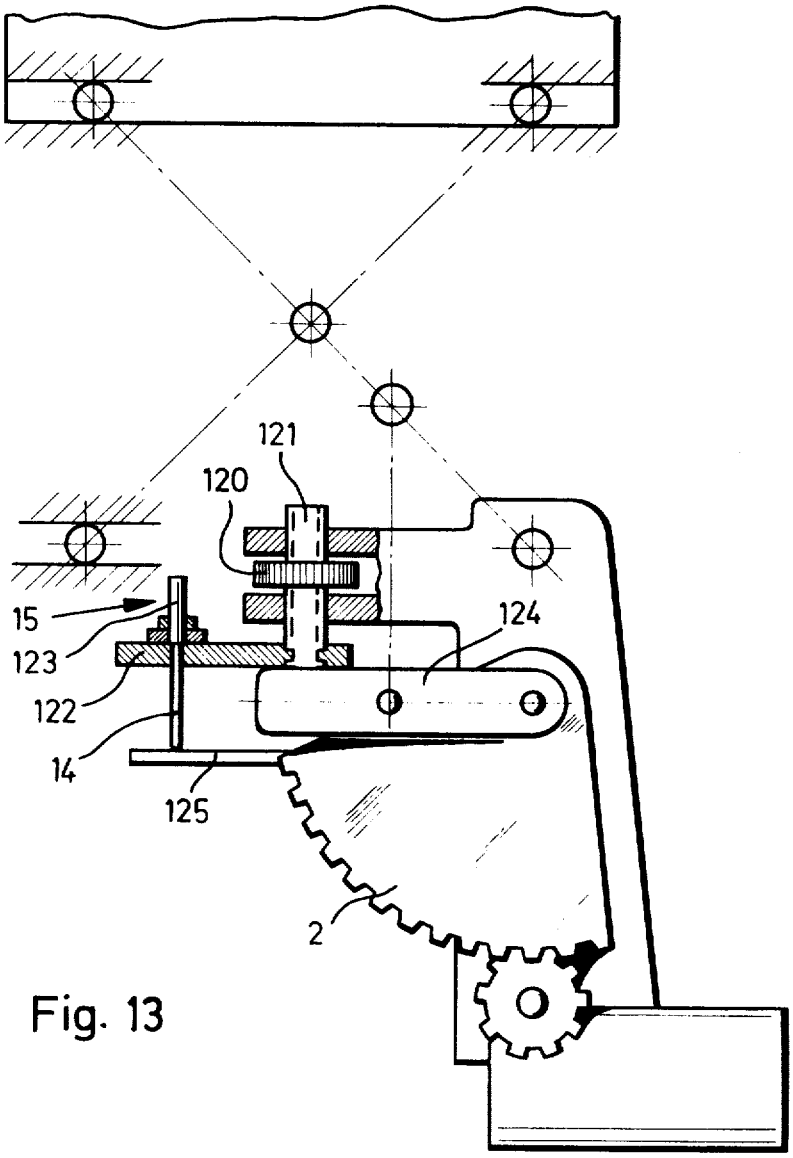
FIG. 13 depicts an installation similar to those of FIG. 11 and 12 but with manual adjustment of the point in which an upward motion of of the window is blocked.

Sometimes it is advantageous, when the blocking point of the window can be manually adjusted. The installation according to FIG. 13 therefore has a knurled nut 120 which can be turned, but not axially displaced. A turn is rather utilized for an axial motion of the threaded bolt 121, which in upward and downward direction thereby adjusts the stop 122 and the covering 123 of a Bowden cable fastened on the stop 122. The freely projecting core 14 too is thereby adjusted upwards and downwards.

When the toothed segment 2 and the lever 124 coupled with said toothed segment via a coupling as already shown by FIGS. 2 to 10, are turned upward, the lever 124 in dependence on the position of the bolt 121 earlier or later hits the stop 122, so that a further upward motion of the window is no longer possible. But due to the coupling between toothed segment 2 and lever 124 the toothed segment can be rotated further and by means of the stud 125 displaces the core 14 of the Bowden cable. Thus, the door is locked. If the window was already brought into its uppermost position before, the door can, of course, be as well locked later.

Figure 14:
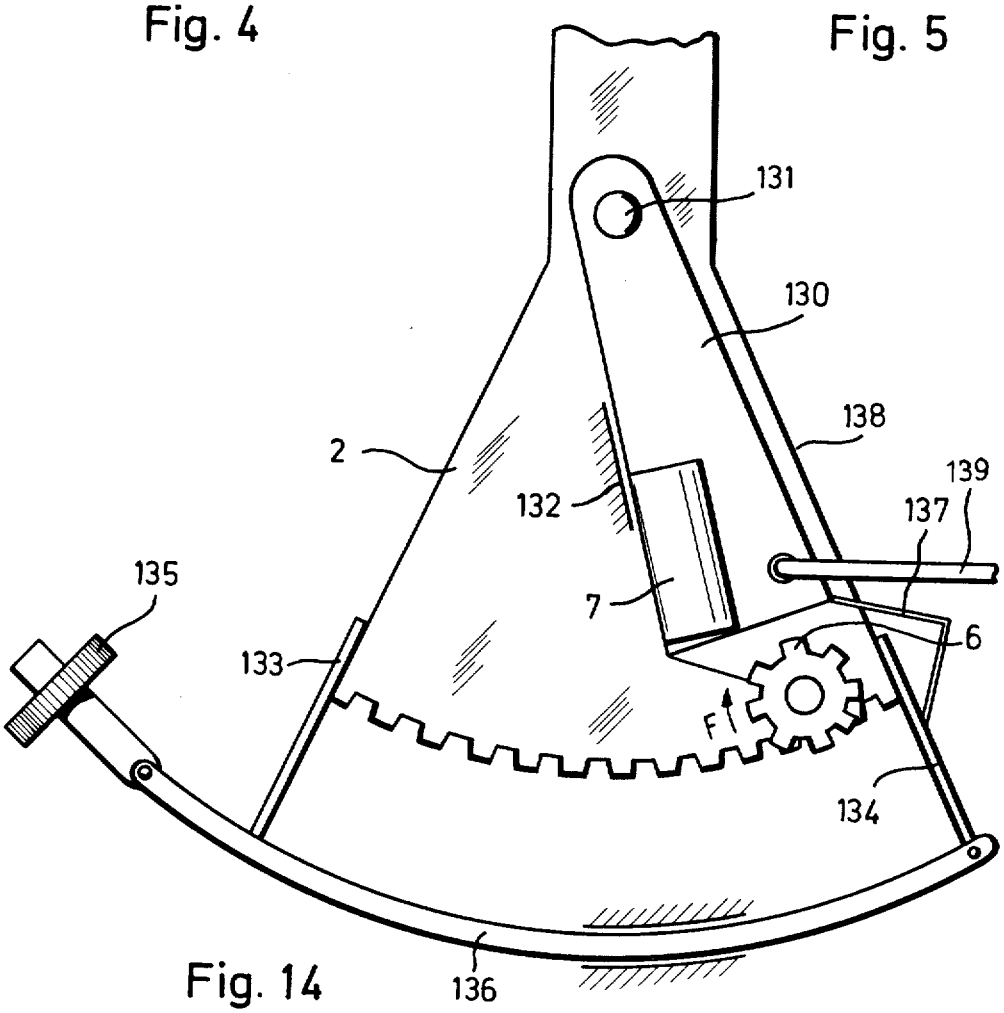
FIG. 14 depicts an installation in which like in the embodiment of FIG. 1 the electric motor may be swivelled and a locking is possible in any position of the window, insofar as the window is blocked only in upward direction.

A manual adjustment of the upper stop point is also provided in the embodiment according to FIG. 14. This installation additionally offers the advantage that during manual adjustment a simultaneous adjustment of the means via which the door is locked, is not necessary. A locking is namely possible independently of the position of the second element, insofar as said element is only blocked.

The electric motor 7 is mounted on a sheet metal 130 which can rotate round the same axle 131 as the toothed segment 2. Said sheet metal is coupled with a part fixed to the vehicle body via a sliding clutch. The motor drives the internally toothed segment 2 via the pinion 6. A rotation of the sheet metal 130 in clockwise direction is prevented by the stop 132. The two stops 133 and 134 are adjustable via the knurled nut 135 and the rod 136. Moreover the stop 134 is movable in anticlockwise direction by a motion of the sheet metal 130. This is indicated by the connection 137.

In the position shown the toothed segment 2 rests on the stop 133. The stop 134 in contrast thereto is not effective for the toothed segment, because it is tilted away from the path of the toothed segment 2. Therefore, the toothed segment can also be moved in anticlockwise direction—thereby the window would be opened. The sliding clutch and the stop 132 thereby prevent a turn of the sheet metal 130. If, however, the pinion is rotated in direction of arrow F, in the position shown thereby a motion of the sheet metal 130 to the right against the force of the sliding clutch is effected, because the toothed segment 2 is blocked by the stop 133. The rod 139 is displaced to the right and the door is locked. Simultaneously the stop 134 is swivelled, so that the toothed segment 2 is blocked too against a rotation in anti-clockwise direction. When the direction of rotation of the motor 7 is reversed, said motor returns to its initial position, so that the door is unlocked again. At the end of the unlocking operation the stop 134 is again tilted, so that the toothed segment is again released for a rotation in anticlockwise direction.

In the described embodiment it is important that the stop 133 as well as the stop 134 is adjusted by the knurled nut 135, so that in a locking operation the stop 134 can always be tilted before the right-hand rim 138 of the toothed segment 2.

Figure 15:
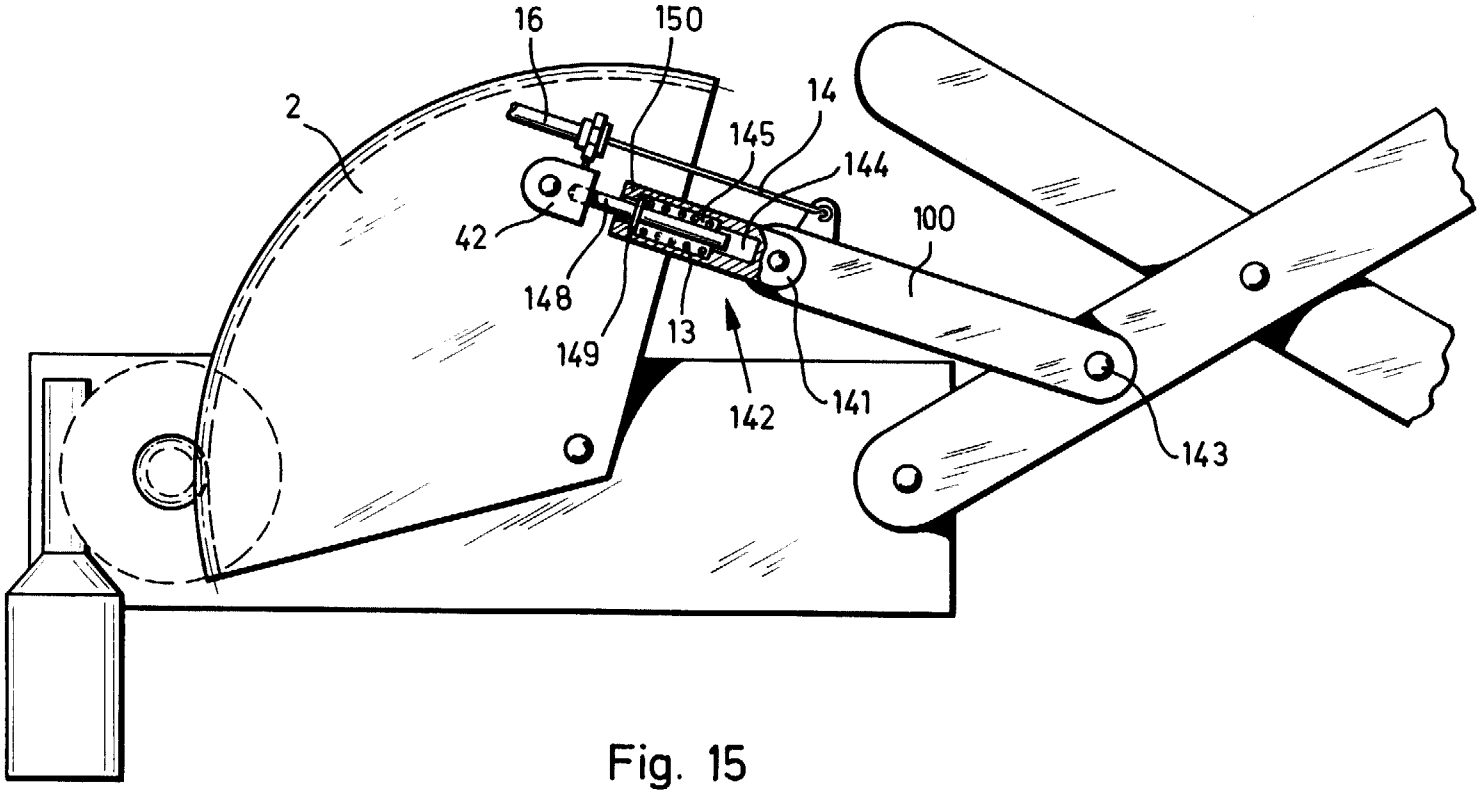
FIG. 15 illustrates an installation, in which the first and second element are mounted between a toothed segment and a linkage.

In FIG. 15 the rod 100 together with the portion 141 of the coupling element 142 represents the second element which, after a blocking of the window, can still rotate round the axle 143. The portion 141 is non-rotatably secured on the rod 140. It has a bore 144 and a recess 145 for the pressure spring 13. With the bolt 148 the coupling element 42 engages into the bore 144 and the recess 145. This coupling element is rotatably mounted on the toothed segment 2. A disk 149 fixed on the bolt 148 is held on the stops 150 of the portion 141 by the pressure spring 13. Thus, the two parts 142 and 42 occupy a safe position towards each other, when the window is moved.

If, however, the toothed segment 2 is rotated beyond the position shown in the drawing in which the window is shut, the spring 13 is pressed and the parts 141 and 42 are moving towards each other. Because the core 14 of a Bowden cable is fastened on the rod 100 and the covering 16 on the coupling element 42, the core 14 and the covering 16 are thereby displaced relative to each other. This effects a locking of the door.

Figure 16:
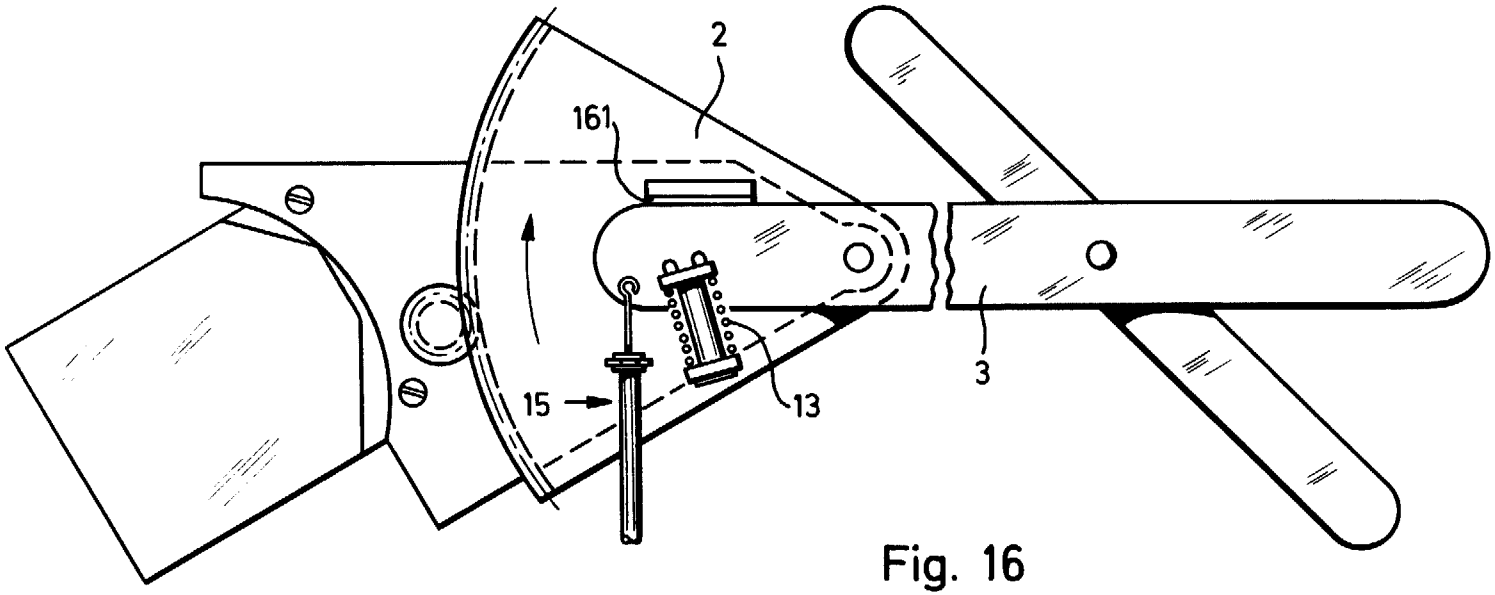
FIG. 16 depicts an installation in which the toothed segment forms the first element and a rod supported on it forms the second element.

In the embodiment of FIG. 15 the spring 13 can transmit a force between the two coupling elements 141 and 42 in both moving directions. In FIG. 16 the spring 13 is effective between the toothed segment 2 and the rod 3 in only one direction. Therefore, the stop 161 against which the spring 13 presses the rod 3 is provided for the motion into the other direction. When the window is blocked, the toothed segment 2 and the spring 13 are displaced against the force of the spring 13, so that a locking of the door if effected via the Bowden cable 15.

Figure 17:
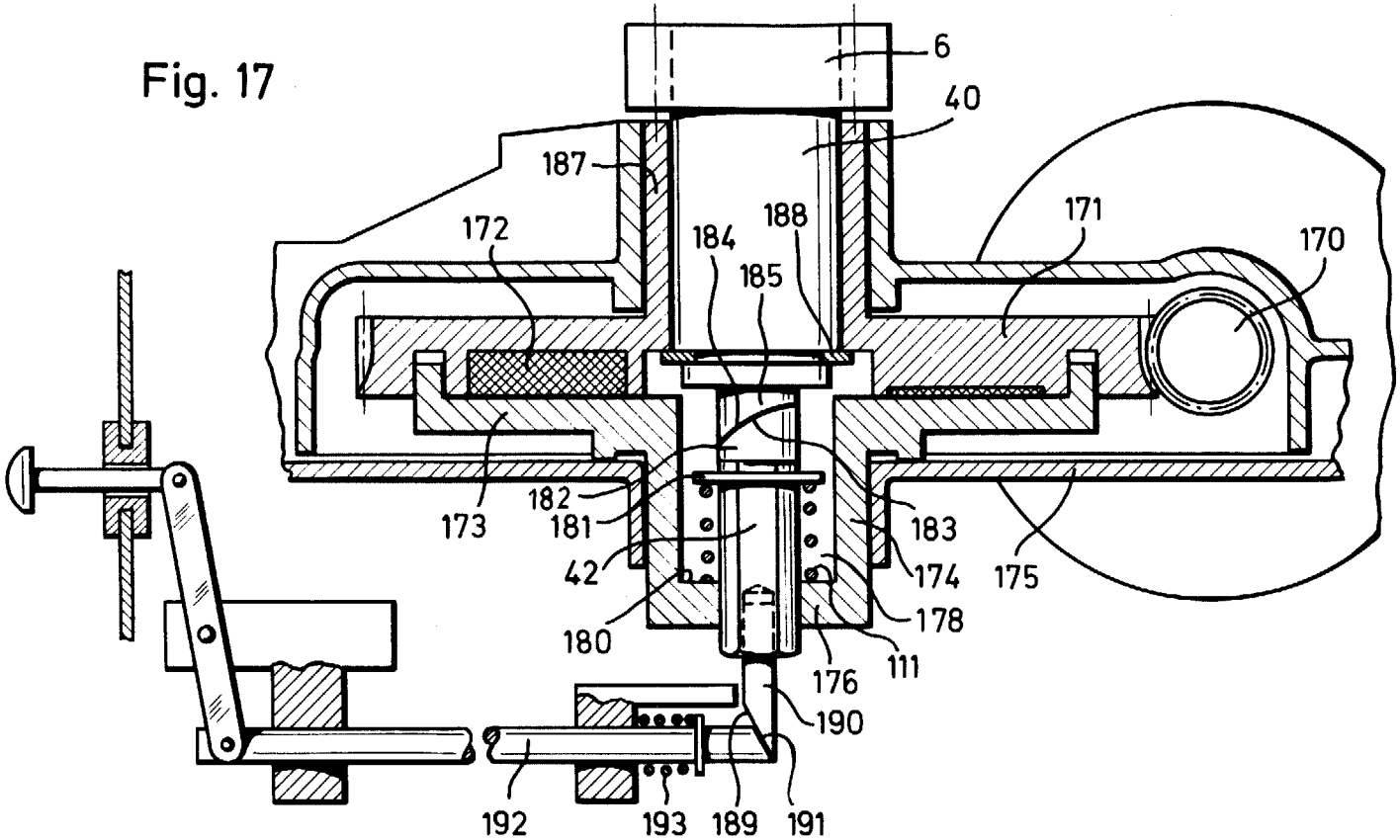
FIG. 17 illustrates a further embodiment of an installation according to the invention in which the first and second element are adjacent to each other with wedge surfaces; and, FIG. 18 is a motor with two-piece worm.
Figure 18:
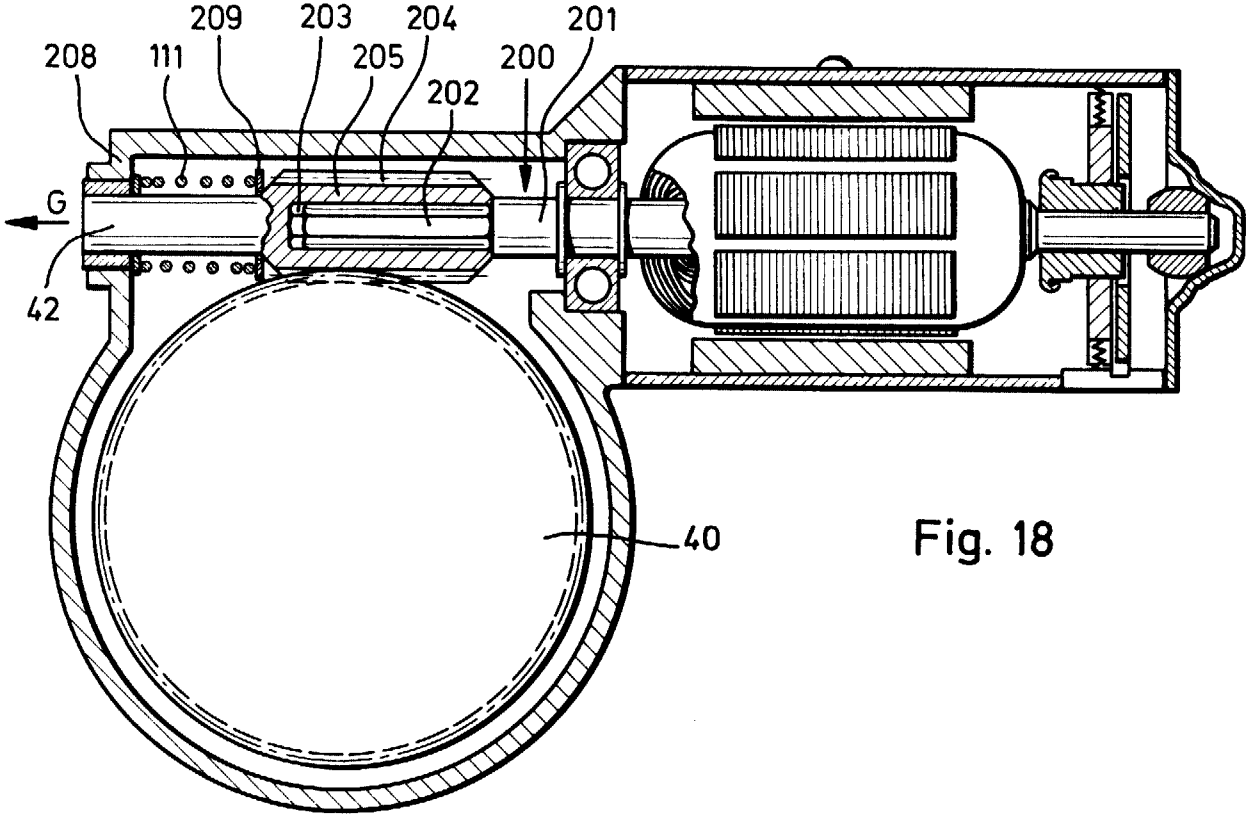

The FIGS. 17 and 18 are showing embodiments of the installation according to the invention in which relatively little is changed in comparison to conventional installations. Above all these changes refer to the gearing of the electric motor.

In the gearing of FIG. 17 the worm 170 is mating with the worm wheel 171 by which the wheel 173 is taken along via the rubber ring 172. Round its axis of rotation this wheel forms a sleeve 174 and is closed outside by a flange 176 having a hexagonal opening through which the hexagon 42 engages into the interiour 178 of the sleeve 174. A pressure spring 111 supports on the inside 180 of the flange 178 and on a ring 181 fastened on the hexagon 42 and holds it in the interiour of the sleeve 174. The hexagon 42 is ending integrally in a round bolt 182 carrying a wedge surface 183. Opposite to said wedge surface 183 a complementarily developed wedge surface 184 of a pin 185 is located which projects from the axle 40 which carries the pinion 6 and is accomodated in a bush 187 of the worm wheel 171. The ring 188 which rests upon the worm wheel 171 and is firmly connected with the axle 40 prevents that the spring 111 can relax.

For lifting and lowering of the window the spring force is sufficient to transmit the necessary power on the axle 40 from the hexagon 42 via the wedge surfaces 183 and 184. If, however, the window is blocked and the motor is energized again the wedge surfaces are displacing towards each other, because the axle 40 is idle, whereas the hexagon 42 continues to rotate. Thereby the hexagon 42 moves in axial direction. By the slope 189 of a pin 190 rotatably mounted in the hexagon 42 which slope 189 cooperates with the slope 191 of the rod, the rod 192 is displaced against the force of the spring 193. This effects a locking of the door. The pin 190 can also have a tip like a pencil. Then it can be connected with the hexagon 42 in a manner protected against twisting.

If an unlocking is to be effected the direction of rotation of the motor is reversed. Thereby the spring 111 again can bring the hexagon 42 and the pin 185 into engagement with each other. The rod 192 is released and the spring 193 unlocks the door, so that the position shown is occupied again. In this embodiment it is especially advantageous that the drive motions can be sensed on different sides of the motor housing.

The embodiment according to FIG. 18 finally is provided with a worm shaft 200 made in two pieces. In addition the armature shaft 201 ends in a hexagon 202. Over said hexagon the sleeve 205 provided with a corresponding opening 203 and on its outside carrying the worm 204 is slipped which is made in one piece with the bearing axle 42. The spring 111 supporting on the housing 208 and on a ring 209 fastened on the bearing axle 42 holds the sleeve 205 and the hexagon 202 in engagement. The worm 204 mates with the worm wheel 40. If this wheel is blocked, because the window is blocked and the motor continues to rotate, the axle 42 with the sleeve 205 displaces against the force of the spring 111 in direction of arrow G. Thereby said axle acts upon further power transmission means, whereby the door is locked. Only when the direction of rotation of the motor is reversed, the sleeve 205 is entirely slipped over the hexagon 202 again. Only a further motion affects the position of the window.

Finally, it should be appreciated that in the embodiments in which the door is unlocked by initially tensioned spring elements or held in unlocked position, when the spring elements are relaxed or are not initially tensioned, the door lock can be developed in such a way that a manual locking is also possible without an immediate unlocking of the door by the spring elements.

What is claimed is:

1. A combination power window and power door locking device for use in an automotive vehicle door comprising, in combination:

an electric motor;

means for mounting said motor internally of said door;

first means for coupling said motor to a movable window pane holder within said door to move said holder between first and second end positions;

second means for coupling said motor to a movable extension of a door locking mechanism within said door which is activated to lock and unlock said door;

means for selectively applying external power to said motor;

means cooperating with said first and second means and responsive to the position of said holder for engaging and activating said door locking mechanism when said holder is in one of its end positions; and, wherein said motor is rotatably mounted in said door and resiliently urged toward an angular stop position until said holder is in said one of its end positions whereupon continued application of said external power to said motor rotates said motor away from said stop position to activate said door locking mechanism.

* * * * *